US008646264B2

(12) United States Patent
Rampen et al.

(10) Patent No.: US 8,646,264 B2
(45) Date of Patent: Feb. 11, 2014

(54) COOLING SYSTEM AND A TRANSMISSION SYSTEM HAVING SAID COOLING SYSTEM INTEGRATED THEREWITH

(75) Inventors: William Rampen, Edinburgh (GB); Niall Caldwell, Edinburgh (GB); Uwe Bernhard Pascall Stein, Edinburgh (GB)

(73) Assignee: Artemis Intelligent Power Ltd, Midlothian (GB)

( * ) Notice: Subject to any disclaimer, the term of this patent is extended or adjusted under 35 U.S.C. 154(b) by 973 days.

(21) Appl. No.: 12/309,691

(22) PCT Filed: Jul. 27, 2007

(86) PCT No.: PCT/GB2007/050456

§ 371 (c)(1),
(2), (4) Date: Apr. 16, 2009

(87) PCT Pub. No.: WO2008/012586

PCT Pub. Date: Jan. 31, 2008

(65) Prior Publication Data

US 2009/0235657 A1 Sep. 24, 2009

(30) Foreign Application Priority Data

Jul. 27, 2006 (GB) ..... 0614939.7

(51) Int. Cl.
*F01P 7/04* (2006.01)

(52) U.S. Cl.
USPC ..... 60/329; 60/456; 60/487

(58) Field of Classification Search
USPC ..... 60/456, 329, 328, 445, 487
See application file for complete search history.

(56) References Cited

U.S. PATENT DOCUMENTS

| | | | | |
|---|---|---|---|---|
| 4,062,188 | A * | 12/1977 | Cutler et al. | 60/599 |
| 4,519,752 | A * | 5/1985 | Valentin | 417/298 |
| 5,944,493 | A * | 8/1999 | Albertin et al. | 417/273 |
| 7,458,414 | B2 * | 12/2008 | Simon | 165/41 |
| 7,856,951 | B2 * | 12/2010 | Kamado et al. | 123/41.49 |
| 2003/0182938 | A1 | 10/2003 | Smith | |
| 2004/0098174 | A1 * | 5/2004 | Suda et al. | 700/299 |
| 2005/0183417 | A1 * | 8/2005 | Nakagawa et al. | 60/456 |
| 2006/0062678 | A1 | 3/2006 | Furuta et al. | |

FOREIGN PATENT DOCUMENTS

| | | |
|---|---|---|
| EP | 1 319 836 | 6/2003 |
| WO | WO 00/64231 | 11/2000 |
| WO | WO 2006/055978 | 5/2006 |

OTHER PUBLICATIONS

International Search Report for PCT/GB2007/050456, mailed Dec. 5, 2007.

Altmann, U. et la. "Elektronisch Geregeites Hydrostatisches Geblaesesystem IM Autombil" MTZ Motortechnische Zeitschrift, vol. 52, No. 12, (Dec. 1,1991), pp. 610-615.

* cited by examiner

*Primary Examiner* — Edward Look
*Assistant Examiner* — Logan Kraft
(74) *Attorney, Agent, or Firm* — Lowe Hauptman & Ham, LLP

(57) ABSTRACT

The present invention provides a cooling system such as employed in cooling a heat source and a transmission system having said cooling system integrated therewith. The cooling system further includes a pump for supplying hydraulic fluid under pressure to a motor for driving a fan employed in the cooling process. In operation, a controller initiates operation of the pump such as to supply hydraulic fluid to said motor only when needed, thereby to improve the efficiency and controllability of the cooling system.

14 Claims, 6 Drawing Sheets

COOLING SYSTEM AND A TRANSMISSION SYSTEM HAVING SAID COOLING SYSTEM INTEGRATED THEREWITH

This application is the U.S. national phase of International Application No. PCT/GB2007/050456, filed 27 Jul. 2007, which designated the U.S. and claims priority to Great Britain Application No. 0614939.7, filed 27 Jul. 2006, the entire contents of each of which are hereby incorporated by reference.

TECHNICAL FIELD

The present invention relates to a cooling system such as employed for cooling a heat source such as an internal combustion engine. It relates particularly, but not exclusively, to a cooling system suitable for integration with a transmission system and a transmission system employing such a cooling system.

BACKGROUND TO THE INVENTION AND PROBLEM TO BE SOLVED

It is well known that heat sources, such as internal combustion engines and the like, must be cooled in order to maintain operation within desired temperature ranges and ensure longevity of the item itself. Internal combustion engines, for example, generate as much as two third of the total energy produced as wasted heat, half of which must be exchanged with the surrounding atmosphere in order to cool the engine. Whilst engines can be air cooled, a radiator system is often used in which hot cooling fluid from the engine is passed through the radiator such as to allow the heat therein to be exchanged with the atmosphere before cooled fluid is returned to the engine for subsequent re-use. Sometimes the forward motion of the vehicle can be sufficient to drive cooling atmospheric air through the radiator but, at low speeds, some forced air movement from a fan arrangement may be required. The mechanical energy required to drive the fan can amount to as much as one tenth of the total energy produced by the engine and the operation of the fan can have a significant effect on the overall efficiency of the engine. In air cooled arrangements, the fan may be employed without the radiator and operated to draw or force air over the engine or an extended cooling surface associated therewith.

Driving the Fan and Problems

The above-mentioned fan may be driven in a number of ways, the least complex of which is a direct drive system in which the fan is driven by a mechanical coupling such as a fan belt connected to a flywheel or the like driven directly from the engine itself. Such an arrangement, whilst providing sufficient cooling for most applications, is wasteful of energy when the radiator or cooling surface is exposed to large amounts of cooling air (e.g. due to a high engine speed) and can often not provide sufficient cooling when the vehicle is stationary. In either arrangement the efficiency and safe operation of the engine may be compromised. An alternative approach employs a hydrostatic fan drive system in which a hydraulic pump driven by the engine is used to drive a hydraulic motor which in turn drives the fan itself. Such an arrangement is preferable to a pure mechanical system as it is possible to employ it in arrangements where a mechanical coupling between the fan and the engine is difficult or impossible due to the relative positions thereof and/or a tortuous path therebetween through which it would be difficult to provide a mechanical drive. Additionally, such systems are able to vary the fan speed and, hence, the cooling rate and thereby reduce the amount of energy used in association with cooling which in turn improves the overall efficiency of the engine itself.

Hydraulic systems of the prior art control the fan speed in one of two ways. Firstly, a fixed displacement pump may be employed in conjunction with a solenoid operated proportional valve which acts to bypass a variable proportion of the flow from the pump such that it does not reach the motor but is throttled to a reservoir thereof. Control of the fan speed is achieved by varying the proportion of flow that is bypassed and, thereby, varying the flow and, hence, speed of the motor driving the fan. Whilst this arrangement does provide a variable fan drive, pumping energy is wasted if any flow is bypassed. Consequently, the system can be both stable and responsive but is still very wasteful of energy. Secondly, a variable displacement pump (usually of the axial-piston swashplate design) may be employed to supply fluid to the motor, and fan speed is controlled by controlling the displacement of the pump. Typically, such arrangements employ a control system in which a demand signal is sent from a controller which is received then employed to alter the angle of the swashplate and, hence, the rate of fluid supply. Due to the mechanical characteristics of a fan as a mechanical load, there is a non-linear one-to-one relationship between pressure across the motor and fan speed and, hence, controlling the pressure allows one to control the fan speed. Unfortunately, these controls require delicate adjustment and are prone to instability due to the pressure dynamics of the circuit. Typically, a compromise is reached whereby a small orifice is inserted in the swashplate control-line which acts to dampen out the motion of the swashplate and even out the supply of fluid. Unfortunately, this damping also reduces the responsiveness of the pump to disturbances such as rapid engine speed changes, which for a fixed fan pressure demand require rapid swashplate movement. The result is that such systems are stable or responsive but seldom both.

SUMMARY OF THE INVENTION

The aim of the present invention is to provide a cooling system suitable for use in cooling a heat source such as an internal combustion engine and a cooling system integrated with a transmission system which is both responsive and economical.

Accordingly, the present invention provides cooling system comprising a heat radiating surface; a fan, for drawing cooling fluid across said heat radiating surface; a hydraulically driven motor, for driving said fan; a source of pressurised hydraulic fluid and a hydraulic fluid delivery controller, for controlling delivery of hydraulic fluid to said motor, in which said source of pressurised fluid comprises one or more working chambers of cyclically changing volume for pressurising a quantity of fluid therein; said system further includes a monitor for monitoring working chamber volume and said controller initiates control over the delivery of fluid from said source on a stroke by stroke basis, thereby to supply fluid in discrete volumes to drive said fan motor and fan.

Preferably, said working chambers include an inlet valve for controlling the return of said fluid to said source thereof and said controller is connected to said inlet valve to maintain said valve open when fluid is not required to drive said fan motor and to close said valve when fluid is so required.

In particularly advantageous arrangements, said inlet valve comprises a solenoid actuated valve. Said valves may comprise one or other of: a normally closed solenoid opened (NCSO) valve; a normally open solenoid closed (NOSC) valve; and a solenoid closed solenoid opened valve, and said controller is connected to said solenoid for opening said valve Advantageously, said system further including a temperature sensor for sensing a monitorable temperature associated with said heat source and in which said temperature sensor is operably connected to said controller for delivering temperature data thereto and said controller is programmed for controlling the supply of hydraulic fluid to said fan motor in accordance with a control strategy determined by the received temperature data.

Preferably, said system further including one or more sensors for sensing one or more of: brake position; accelerator position; throttle/gear position; engine control data; ambient temperature; vehicle weight; terrain incline; pump RPM and accessory/engine load and wherein said sensor or sensors are connected to said controller for delivering data thereto and said controller is programmed for controlling the output of said pump in accordance with said data.

Preferably, said controller is programmed to monitor one or more of said monitored parameters and initiate cooling in advance of a predicted demand therefore.

In a particularly simple arrangement, said outlet valve comprises a normally closed pressure opened valve or a solenoid valve.

In a particularly safe and preferred arrangement, said inlet valve comprises a normally closed solenoid opened valve.

Advantageously, the controller includes a look up table having data recorded thereon corresponding to pre-recorded heating or cooling profiles and wherein said controller controls said valve or valves in accordance with said look up table.

Preferably, the controller is an adaptive controller for learning start and stop profiles of a vehicle associated with said transmission and modifying the cooling profile in accordance therewith.

In one arrangement the heat radiating surface receives heat from an internal combustion engine.

The system may include a heat source in the form of an internal combustion system and may include a second fluid pump driven from said engine, said second fluid pump driving a motor coupled for driving a transmission.

Preferably, when the system includes an internal combustion engine or other source of heat which can be cooled by liquid cooling the system further includes a fluid radiator for receiving cooling fluid from said engine and said fan is positioned to draw or drive ambient air over said radiator, thereby to cool the contents thereof.

The above system may further include a temperature sensor wherein said temperature sensor senses the temperature of cooling fluid in a cooling circuit.

In an alternative "air cooled" arrangement, said fan is positioned to draw or drive ambient air over a surface of said engine, thereby to cool said engine directly. Such an arrangement may also be provided with a temperature sensor for sensing the temperature of a component of said heat source.

The present invention will now be more particularly described, by way of example only, with reference to the accompanying drawings, in which.

DESCRIPTION OF THE BASIC CIRCUIT AND COMPONENTS

Figure 1:
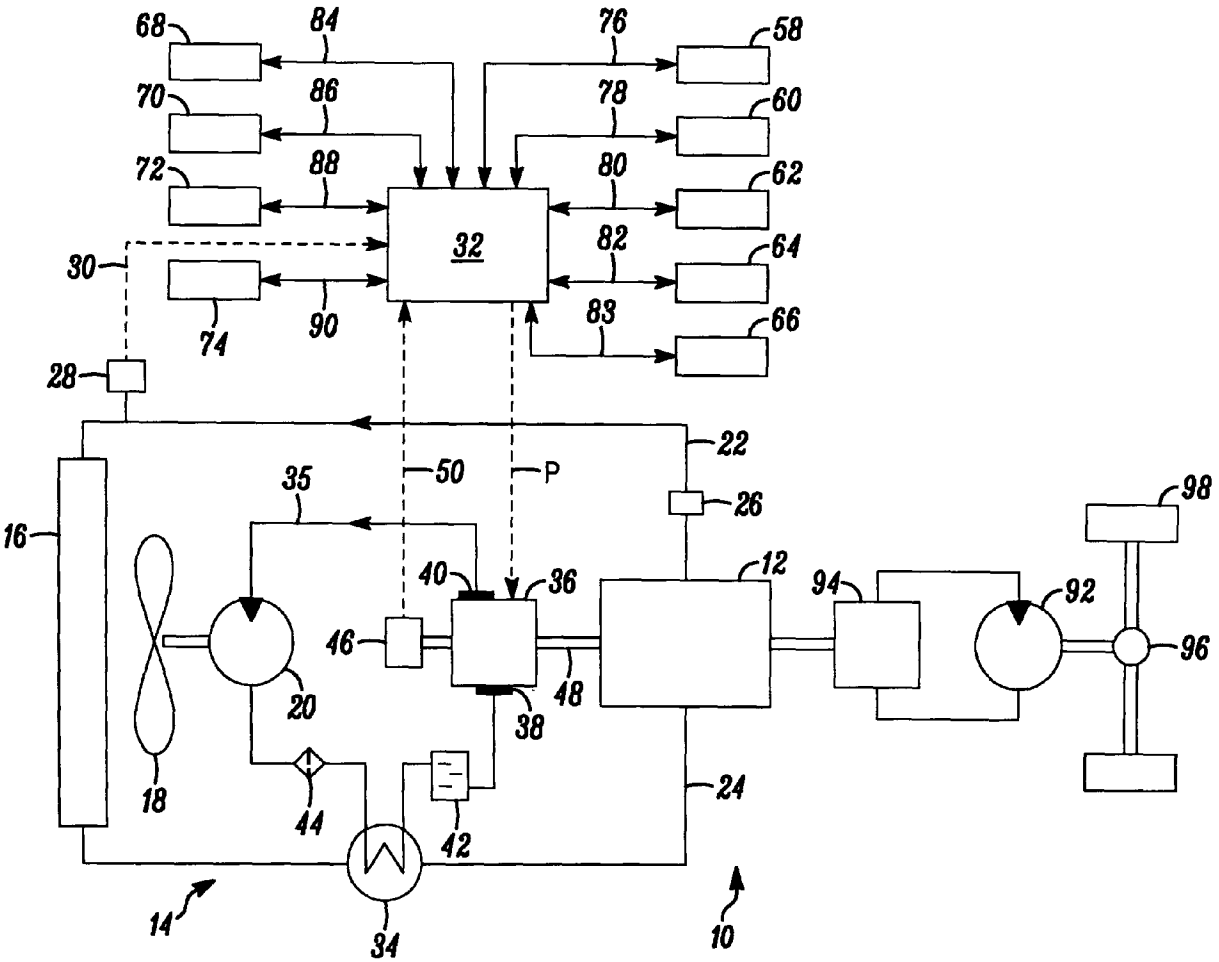
FIG. 1 is a schematic representation of a cooling system and transmission system according to the present invention.

FIG. 1 illustrates a first embodiment of the present invention and includes, a transmission system shown generally at 10, a heat source in the form of an engine 12 and a liquid based cooling system shown generally at 14. Such a cooling system 14 includes a heat radiating surface or radiator 16, a fan 18 for driving or drawing air through the radiator and a hydraulic fan motor 20 for driving said fan 18. A fluid supply line 22 is provided between the engine 12 and the radiator 16 for supplying hot cooling fluid thereto and a return line 24 is provided for returning cooled cooling fluid to the engine 12, in the manner known to those skilled in the art. A cooling circuit pump 26 may be provided to assist with the flow of fluid through the cooling circuit and a temperature sensor 28 may be provided for sensing a monitorable temperature associated with the heat source, such as the temperature of the cooling fluid leaving the engine 12. The sensor 28 is connected to a data line 30 for sending a signal indicative of the sensed temperature to a controller shown generally at 32 and to be described in more detail later herein. The return side of the cooling circuit may be provided with an optional hydraulic fluid cooling fluid to water heat exchanger 34 which employs cooled fluid from the radiator 16 to cool the hydraulic fluid in the fan circuit.

It will be appreciated by those skilled in the art that the present invention may be employed in other cooling arrangements which require or would benefit from better control or higher cooling efficiency. One such example is an air cooled internal combustion engine which is discussed in detail later herein with reference to FIG. 9.

The fan motor 20 may be of the fixed displacement type and is supplied with pressurized driving fluid through line 35 which in turn is connected for fluid flow to a hydraulic pump shown generally at 36, and illustrated in more detail in the later figures.

The pump 36 is preferably of the variable displacement type and provided with an inlet port 38 and an outlet port 40, the use of which will be described in more detail later herein. Also provided in the hydraulic circuit is a reservoir 42 for retaining a ready supply of hydraulic fluid and an optional filter 44 for filtering the fluid as it passes around the circuit.

A sensor in the form of, for example, a position sensor 46 is provided to monitor the angular position of the pump shaft 48 (FIG. 2) and is connected to the controller via line 50 so as to supply positional data thereto for purposes which will become apparent later herein.

The controller 32 is provided with control lines 52 and 56 linked to inlet and outlet valves (best seen in FIG. 2) of one or more cylinders associated with the pump 36. The detail of the valves and the operation thereof is described later herein with reference to FIGS. 2 to 8. Further sensors may be provided at 58 to 74 for monitoring one or more of brake position 58, accelerator position 60, throttle/gear position 62, engine controller data 64, ambient temperature 66, vehicle weight 68, terrain incline 70, pump RPM 72, and accessory/engine load 74. Data lines 76 to 90 are provided for supplying/exchanging data with or to the controller and the various sensors.

Optional Features/Arrangements

An additional feature of the arrangement may include a second hydraulic motor 92 driven by fluid pump 94 and having an output for driving a differential and/or a vehicle wheel arrangement shown diagrammatically at 96 and 98 respectively. In an alternative arrangement, second hydraulic motor may be driven by the first hydraulic pump 36 described above in relation to the cooling circuit.

Detailed Description of the DDP

Figure 2:
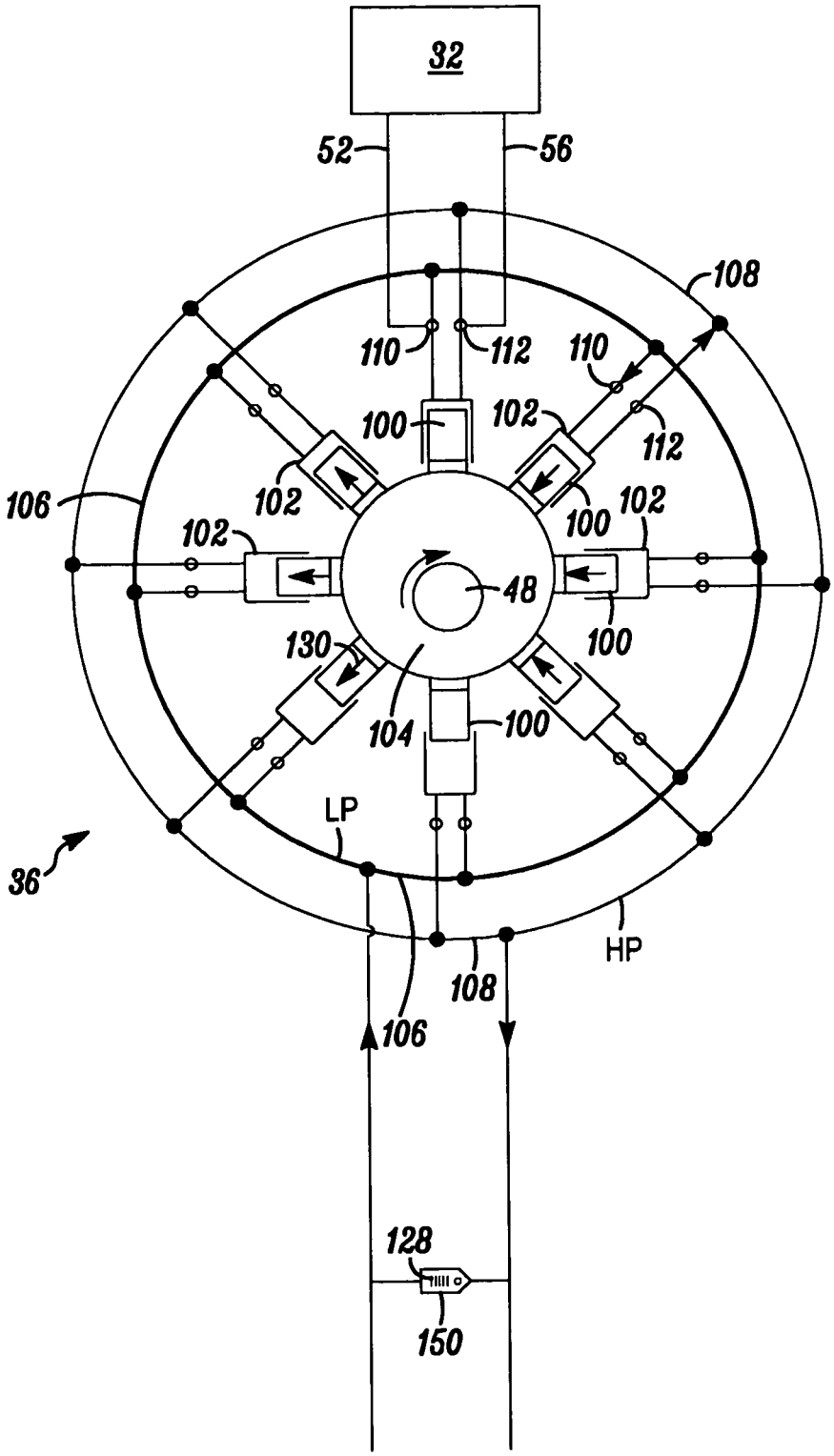
FIG. 2 is a schematic representation of the pump arrangement shown generally in FIG. 1.
Figure 3:
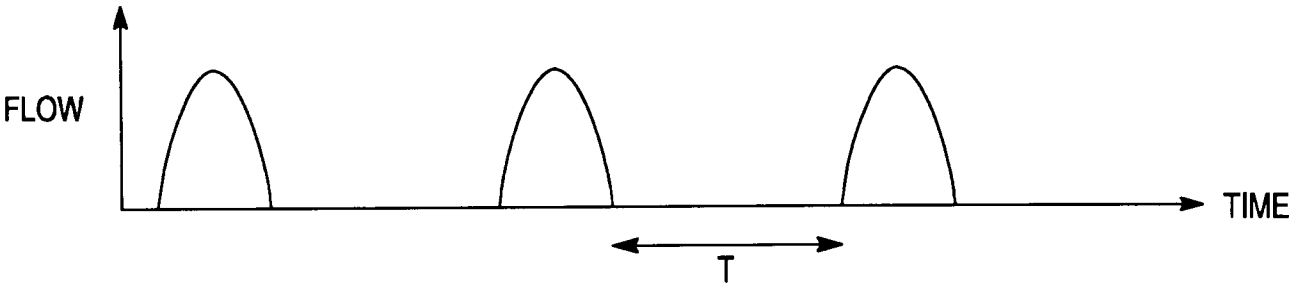
FIGS. 3 and 4 illustrate two possible fluid pumping profiles with FIG. 4 illustrating multiple fluid pulses from a multi-chambered pumping arrangement.

The reader's attention is now drawn to FIGS. 2 and 3 which illustrate the pump 36 in more detail and from which the reader will appreciate that it comprises a reciprocating piston pump arrangement having one or more pistons 100 provided in one or more cylinders 102. The pistons 100 are driven off a common drive in the form of an off-centre cam arrangement 104 which is, in turn, driven by a prime mover such as a motor 12 via shaft 48. An inlet manifold 106 may be provided when a multi cylinder arrangement is used and said manifold acts to receive low pressure hydraulic fluid from the reservoir 42 via low pressure port 38 of FIG. 1. The outlet side may also be provided with a manifold which is shown at 108 and connected for receiving pressurized fluid from the cylinders 92 and for supplying it to the high pressure port 40 of FIG. 1. Preferably, the pump 36 comprises a Digital Displacement Pump (DDP) of the positive displacement type commutated by inlet and outlet valves shown generally at 110 and 112 which are preferably of the poppet type in order to provide discrete pulses of high pressure fluid to the fan motor 20.

Operation of the Pump

The pump 36 has two modes of operation namely: pumping and idling. When used in the pumping mode fluid is positively driven out of the pump 36 by closing the inlet valve which causes fluid to be driven out of an operable chamber through the outlet valve and supplied to the fan high pressure port of FIG. 1 and then to motor 20. However, when the pump is operated in idle mode the inlet valve is maintained open and fluid is prevented from being supplied to the high pressure port 40 of FIG. 1 due to valve 112 being maintained in a closed position by means to be described in detail later herein. In this second mode, fluid within an operable chamber simply returns to the inlet side for subsequent re-use. The controller 32 decides, on a stroke-by-stroke basis, whether a working chamber should execute a pumping or idling stroke and actuates the commutating solenoid valves accordingly. Control of fluid displacement of the machine may be achieved by varying the time-averaged proportion of working chambers which execute pumping strokes, compared to those which execute idling strokes, and also by modulating the timing of the valve actuations. Each high-pressure fluid pulse produced or absorbed by each working chamber is individually commanded by the controller.

Advantages

From the above, it will be appreciated that a working chamber executing an idling stroke is isolated from the high-pressure port 40, and thereby that working chamber mechanism is unloaded, causing no volumetric loss or pressure-related mechanical loss. This aspect of operation provides the present invention with a major advantage over known hydraulically actuated cooling systems in that it allows the system to supply discrete volumes of hydraulic fluid under pressure to a motor able to receive it and convert it into rotation of a fan for the purpose of cooling. When cooling is not required then fluid is not pressurised or pumped and little if any energy is expended. This is in stark contrast with the arrangements of the prior art which is always pressurising the working fluid and effectively wastes the energy used to pressurise it whenever it is not needed.

Pumping Profiles

Figure 4:
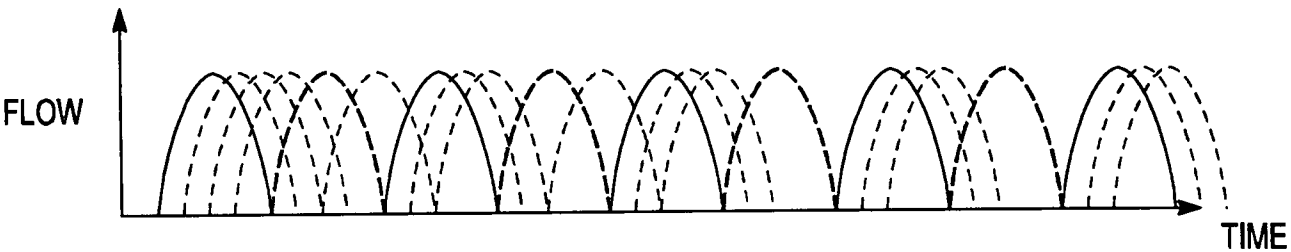

By way of illustration of the pumping profile possible with the present invention, we draw the reader's attention to FIGS. 3 and 4, which illustrate two possible pumping profiles. In FIG. 3 the profile is such as to produce a series of discrete pulses, each of which is separated from its neighbour by a time period T which may be varied as required. Such a profile provides sufficient fluid to keep the fan motor turning at a slow but controllable speed and the profile can be altered by increasing or reducing the number of pulses as and when necessary. FIG. 4 illustrates the profile when the pump is being operated at varying capacity and the flow comprises a series of more closely positioned pulses of pressurised fluid being supplied to the fan motor. As shown, the regularity of the pulses varies, as would be the case with varying cooling requirements. Continuous operation with a constant flow is also possible.

Valve Types

Figure 5:
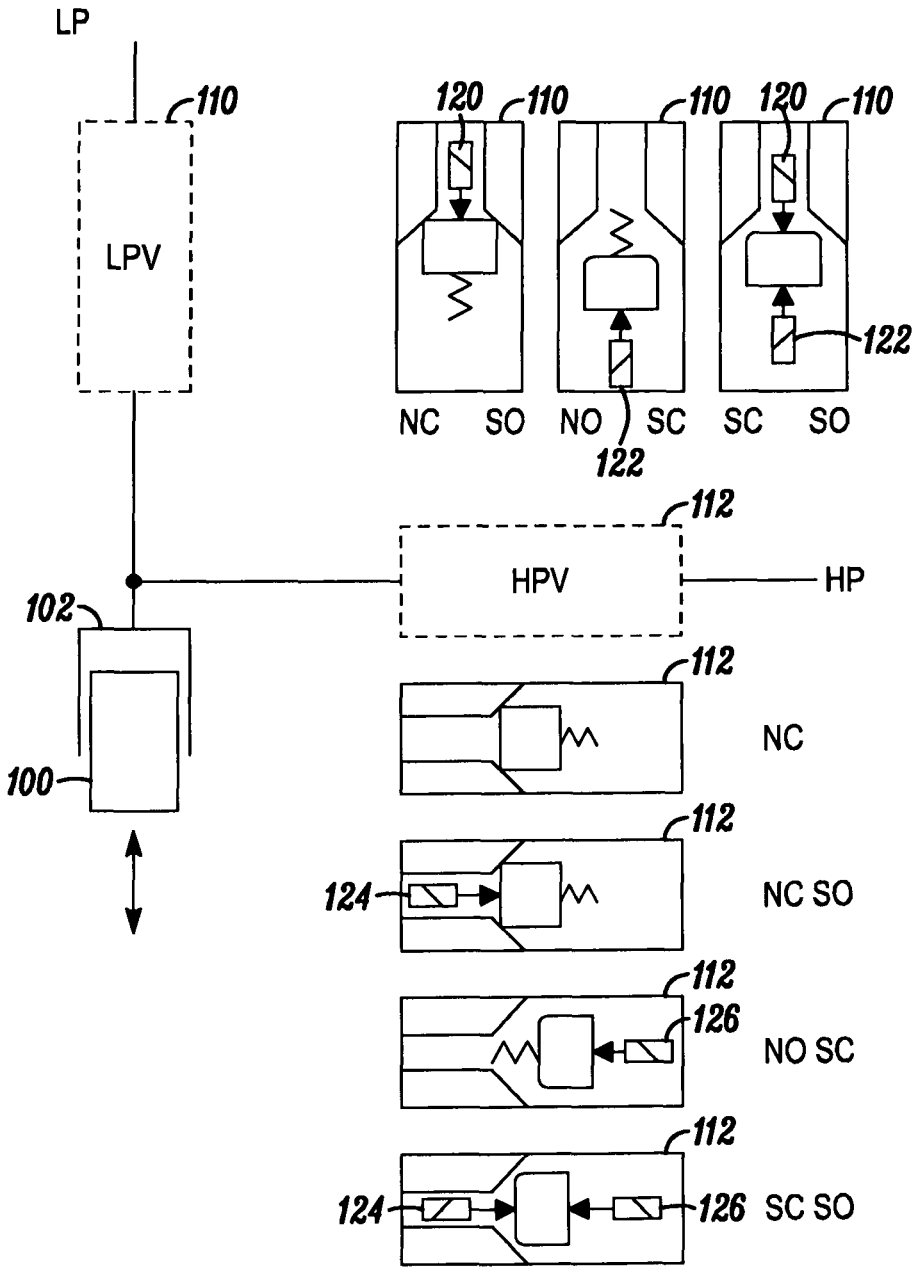
FIG. 5 is a diagrammatic representation of alternative valve arrangements associated with the pump of FIGS. 1 to 3.

FIG. 5 illustrates a number of valve combinations that may be employed in the present invention, most of which are direct acting solenoid activated valves having the solenoid indicated at 120 to 126. It will be appreciated that the valves may be used in different combinations depending upon the functional requirements of the system. The first inlet or low pressure (LP) valve is a normally closed solenoid opened valve (NCSO) and has the solenoid connected to receive actuation energy/command signals from the controller 32 of FIGS. 1 and 2. Alternatives include a normally open solenoid closed valve (NOSC) and a solenoid closed solenoid opened (SCSO) valve, each of which will require its associated solenoids 120 and 122 to be connected to the controller 32 and/power source for receiving activation signals as and when necessary. In various of these arrangements a spring 128 may be employed to bias the valve in one particular direction. The valves on the outlet or high pressure (HP) side may be of similar construction having a spring biasing system where necessary and may include one or more solenoid actuators 124 and 126. A simple sprung biased normally closed (NC) valve having no solenoid at all and which is opened simply by the pressure created in the chamber 102 may also be employed and provides the simplest arrangement of all. The controller 32 is used to manage the flow of fluid into and out of the chambers 92 in a manner which results in fluid either being pressurised and supplied to the fan motor 20 or drawn into the chamber and then returned without being pressurised towards the source of fluid 42 via the inlet valve 38. The amount of energy expended in drawing in and then returning fluid that is not needed for driving the fan motor 20 is minimal and certainly far less than that wasted by the prior art arrangements that compress all the fluid taken into a chamber and then simply waste unwanted fluid by allowing it to be depressurised.

Phases of Operation of Above Valves

Figure 6:
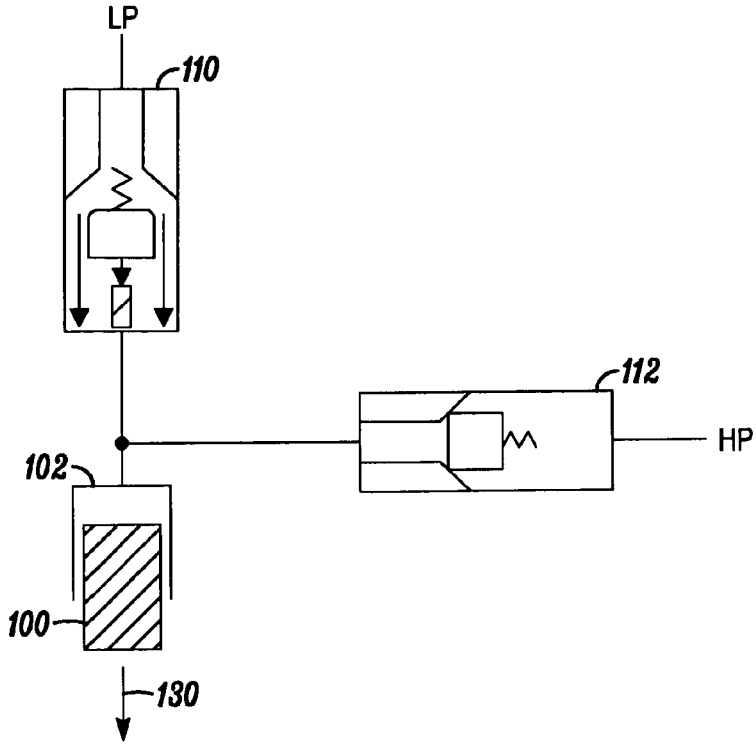
FIGS. 6 to 8 illustrate the fluid flow associated with first and second modes of operation of the present invention.
Figure 7:
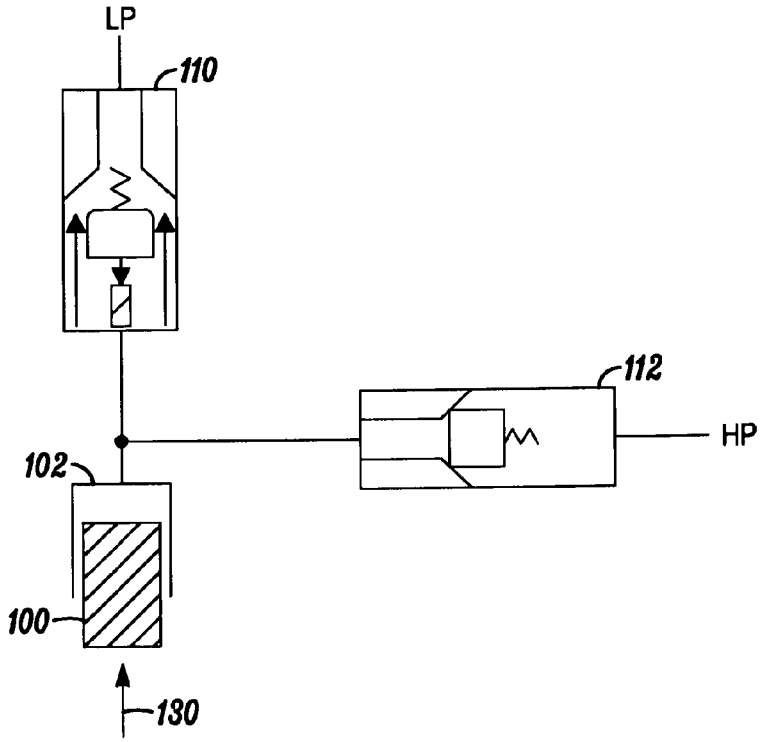
Figure 8:
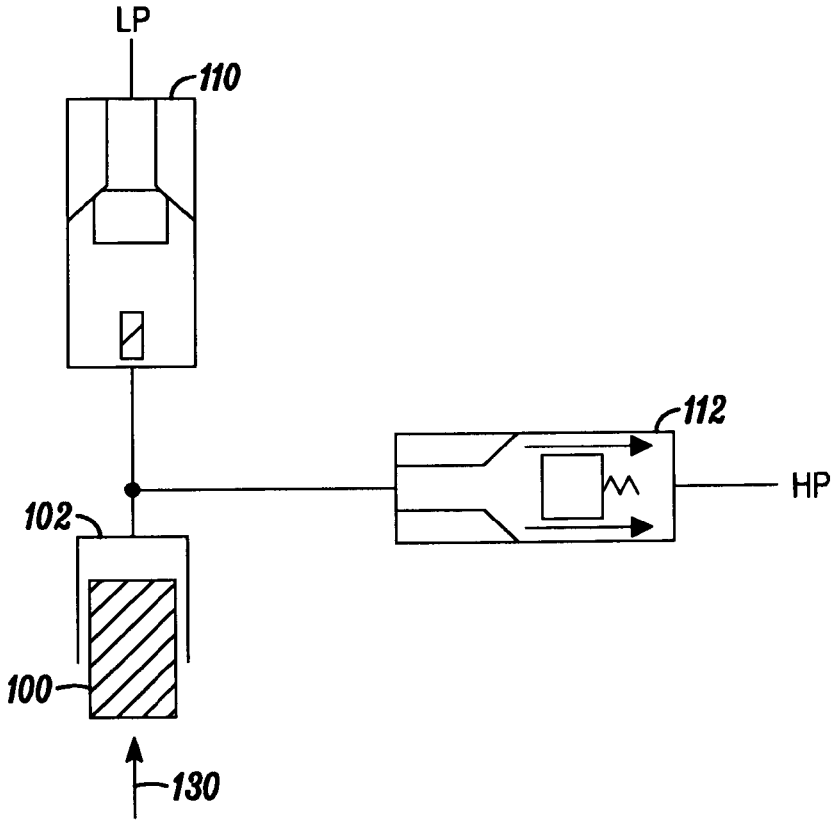

FIGS. 6 to 8 illustrate the three phases of operation of the cylinder and valve arrangements described above. In FIG. 6, fluid is being drawn into the chamber 102 by opening valve 38 such as to allow the chamber to communicate with the source of fluid 42 and drawing fluid in through the action of the piston which creates a low pressure within the chamber as it moves downwardly in the direction of arrow 130. Once this fluid is within the chamber 102 the controller 32 makes a decision on the need for that fluid as a pressurised fluid to drive the fan motor 20. Should the controller determine that the fluid is not needed for driving the fan then the LP valve 110 is kept open and the drawn fluid is simply returned to the LP manifold as the piston rises, as shown in FIG. 7. FIG. 8 illustrates the arrangement where the controller 32 determines that the fan motor 20 should be provided with pressurised fluid so as to drive the fan 18 and under these circumstances the LP valve 110 is closed by activation of the solenoid 120/122 associated therewith. Fluid within the chamber 102 is pressurised as the piston rises and as the pressure thereof overcomes the pressure maintaining the HP valve closed or the solenoid associated therewith is activated and pressurised fluid is supplied to the HP manifold for subsequent use. The spring pressure associated with the HP valve is simply such as to maintain the valve closed under low pressure conditions It will be appreciated that the above operational sequence is repeated for each cylinder of the pump and for each revolution of the driving crank. By controlling the LP inlet valves at discrete points in the rotational cycle of the pump a cylinder can effectively be turned "on" or "off" in as much as it either supplies pressurised fluid to the HP manifold or returns unpressurised fluid to the LP manifold. By adopting this approach the controller 32 is able to deliver, on a stroke-by-stroke basis, discrete pulses or volumes of pressurised fluid to the fan pump 20, in the manner of FIGS. 3 and 4, and cause the fan motor to be driven, stopped or the speed thereof varied in accordance with a desired demand.

The demand itself may be determined my monitoring one or more parameters such as cooling fluid temperature via sensor 28 or data from any one or more of optional additional sensors provided at 58 to 72 for monitoring one or more of brake position 58, accelerator position 60, throttle/gear position 62, engine controller data 64, ambient temperature 66, vehicle weight 68, terrain incline 70 and pump RPM 74

Normal Operation

In normal operation, the controller 32 receives a signal from transducer 28 corresponding to the monitored temperature, and a pulse signal 50 corresponding to the position of the shaft 48 of the digital fluid modulator or pump 36 which is representative of the speed of the prime mover or engine 12. The controller 32 decides on the desired speed of the fan 18 such that the correct amount of heat is lost to the atmosphere, so that the engine is maintained at the desired temperature. The relationship between cooling power demand and fan speed can be calculated by use of a look-up table or an equation. On the basis of the desired speed of the fan 18, the known effective displacement of the motor 12, and the speed of the shaft 48 corresponding to the frequency of pulse signal 50, the controller 32 calculates the frequency of pulses P to be sent to the pump 36 such that the fan motor 20 rotates at the desired speed. Hence the frequency of the pulses depends on the desired fan speed, with the phasing of those pulses being kept constant by the controller with regard to the shaft position pulse signal 50. If the frequency of pulses required to achieve the desired fan speed exceeds the capability of the digital fluid modulator at the current shaft speed, the signal will saturate at the maximum frequency depending on the speed of the shaft 48 which is derived from signal 50.

Control Circuit

Control of the LP and HP valves 110, 112 may be initiated as and when necessary by means of any suitable control circuit that can initiate operation of the solenoids described above in response to monitored parameters, as described above. Such circuits are common in the art and for the purposes of brevity are not described further herein. It will, however, be appreciated that in order to produce a fluid pulse corresponding to a constant fraction of the full swept volume of the cylinder it is necessary for the controller to initiate a pulse operational signal which is phase locked to the rotational angle of the shaft 48. This may be done by means of the controller receiving a positional signal 50 from position sensor 46 which monitors the position of the pump shaft 48 and hence can be used to determine when the next cylinder is about to become available for use to supply pressurised fluid or turned off so as to cause fluid to be returned to the low pressure manifold side. Additionally, it will be appreciated that by monitoring the angular position of said shaft one can effectively monitor the working chamber volume available at any one time.

In a preferred arrangement the LP valves are normally closed, solenoid opened (NCSO) valves which need no electrical signal to maintain them closed and are held open against flow by supplying an electrical signal thereto. Such valves are inherently safe as they allow for pumping and, hence, cooling to continue even when the electrical supply to said valves 30 fails. In operation, valves are maintained closed by virtue of the "normally closed" status and fluid flow to the fan motor is maintained unless the controller determines that flow should be terminated. Once this determination has been made an electrical signal is transmitted to said solenoids such as to cause said valves to remain open and return unpressurised fluid to the low pressure manifold. Other valves such as the Normally Open, Solenoid Closed (NOSC) and the Solenoid Closed, Solenoid Opened (SCSO) are operated in the appropriate manner to supply an electrical supply to said solenoid valve to move it as and when necessary in order to allow or prevent fluid therethrough as and when desired.

In an even simpler arrangement, the HP valve comprises a spring biased valve having a slight spring pressure maintaining the valve closed and in which the pressure from the HP manifold also maintains the valve closed unless the pressure in the piston chamber being pumped exceeds that of the HP manifold. Under such circumstances the pressure in the piston chamber causes the valve to open and pressurised fluid is supplied to the HP chamber.

Additional Possible Operational Modes

In addition to the above, the control may be such as to provide a more predictive or active control in which future demand for cooling is determined or predicted by means of the optional sensors or a look-up table. For example, if the vehicle is sensed to be decelerating it is likely to be accelerating again shortly as it pulls away from rest. Under these circumstances it is possible and desirable to cause HP fluid to be supplied to the fan motor 20 in advance of said acceleration, so as to facilitate cooling of the cooling fluid in advance of demand. Other sensors may be employed to facilitate this predictive cooling aspect such as, for example, the incline sensor which may be employed to predict an increase or reduction in required cooling due to an increase or decrease in the incline angle. Indeed, any of the sensors described with reference to FIG. 1 above may be used to predict or determine future or actual demand.

Alternatives and Improvements

In the above embodiment, the idle mode of the pump 36 involves the working chamber being connected to the low pressure inlet for both expansion and contraction strokes. However, the idle mode may alternatively comprise the working chamber being isolated from both ports of the machine such that during the expansion stroke the working chamber pressure falls to a partial vacuum. In both cases, chambers configured in the idle mode do not displace fluid into the high pressure port.

It will be appreciated that the pump 36 may have a single or multiplicity of reciprocating fluid volumes, in which case each solenoid valve for each reciprocating volume is supplied with an individual activation signal. In a multi-cylinder case the activation signal may comprise a number of parallel signals, each of which controls a separate solenoid valve. If the fluid volumes reciprocate with different phases relative to the input shaft, then the signals or pulses sent to each of these solenoid valves must be phased accordingly relative to the shaft position signal 50.

A pressure-relief valve shown schematically at 150 may be fitted to the high-pressure line supplying the motor to protect against transient pressures above the safe rating of the hoses or other components.

Figure 9:
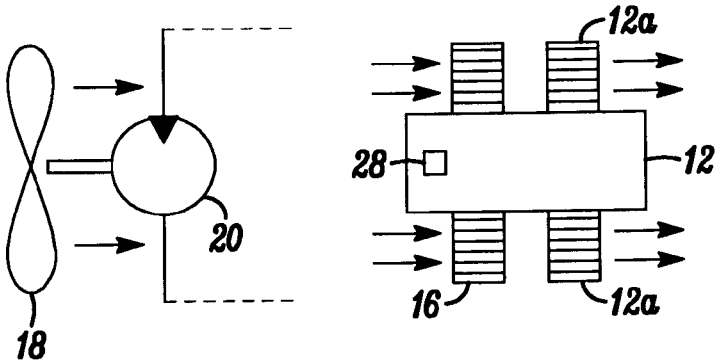
FIG. 9 is a schematic representation of how the fan of the present invention may be positioned when used in an air cooled engine application.

Although the system described above refers mainly to a liquid-cooled engine, its use with an air-cooled engine is also possible, in such an arrangement temperature transducer 28 would sense a monitorable temperature associated with a part of the engine rather than the temperature of the cooling liquid (as in FIG. 1). Such an arrangement is shown in FIG. 9 which shows a fan 18 directing ambient air over the engine 12 and/or an extended surface thereof such as cylinder fins 12*a* which effectively form a heat radiating surface in the manner of the radiator 16 of FIG. 1.

Several further improvements to the overall system control are possible with this arrangement. For example, when the engine is at low temperature the fan can be kept revolving to reduce thermal stresses across the radiator matrix. By inputting the engine fuel consumption and speed and the ambient temperature to the fan controller, a predictive algorithm can be used to calculate the heat removal rate from the radiator such that the engine always operates near the optimum temperature. Such an algorithm can employ the thermal inertia of the cooling system to allow the fan system to be over-driven when the prime mover efficiency or available power is high, or there is excess energy being put into the prime mover (for example when it is used for engine braking with or without a retarder). Since fan power increases much faster than its consequent cooling effect, there is a significant gain in energy efficiency to be had by time averaging the cooling load in this way.

If a friction belt drive is used between the digital fluid modulator and the engine, the phase between the shaft of the digital fluid modulator and the engine may vary depending on slip in the belt. However, if a synchronous drive arrangement is used such as a synchronous belt, gear or shaft, then it is possible that a position sensor internal to the engine may be used to synchronise the pulses from the controller with the shaft of the digital fluid modulator. It is also possible that all of the control functions of the controller be incorporated into the electronic control unit of the engine.

It will also be appreciated that the controller 32 may be an adaptive controller able to learn start and stop sequences and the cooling demands associated therewith and for modifying the cooling profile in accordance therewith. Indeed, the controller 32 may be programmed to learn from the cooling demands dictated by changes in any one or more of the monitored parameters such as incline or vehicle weight etc.

Advantages

In contrast to the disclosure of the prior art, in the preferred embodiment of the invention, the default state of the inlet solenoid-controlled valves is held closed by a spring and/or by fluid pressure, and the valves are opened by operating their solenoids or overcoming the pressure in the high pressure manifold. This means that in the event of an electrical failure, the pump continues to displace fluid towards the load (fan motor) rather than simply idling. Thus safety is enhanced as engine cooling is maintained.

In comparison with the prior art of the fixed-displacement pump type, the system is very energy efficient as there is no dissipative proportional valve. Almost all of the fluid energy produced by the digital fluid modulator is used to turn the motor with only a small amount being lost due to friction in the connecting pipes.

In comparison with the prior art of the variable-displacement pump type, the system is very stable because there is no swashplate to position and, hence, no closed-loop servo control system is required. The frequency of pulses is decided by the controller "open loop" depending solely on the demanded fan speed. Again in comparison with this second type of prior art, the system is highly responsive because the controller 32 can change the pulse frequency very rapidly, free of the constraints of a swashplate control mechanism which has a finite response speed. The flow of pulses from the digital fluid modulator can transition from that of FIG. 2 to that of FIG. 3 without significant time delay.

The high rotational inertia of the fan means that the speed of the fan is smooth in spite of the pulsating nature of the flow supplied by the pump 36. During the period in which flow is not being supplied, the check valves built into the digital fluid modulator ensures that the line does not fall below atmospheric pressure, which would otherwise cause air to be released from the hydraulic fluid possibly leading to noise, and damage of the hydraulic motor. Alternatively, a simple additional check valve may be provided.

The system described is efficient of energy, stable and responsive and hence an improvement on the prior art.

The invention claimed is:

1. A cooling system comprising:

a heat radiator;

a fan for forcing cooling fluid across said heat radiator;

a hydraulically driven motor for driving said fan;

a hydraulic pump having a working cycle and configured to be driven by an off-center cam arrangement, and the hydraulic pump configured to provide pressurized hydraulic fluid to power said motor during said working cycle, said pump having at least one outlet valve comprising a normally closed pressure opened valve and at least one inlet valve comprising a normally closed solenoid opened valve;

a pump shaft speed sensor for indicating a speed of said pump shaft;

one or more sensors for sensing one or more parameters to alter a rate of cooling induced by the fan; and a hydraulic fluid delivery controller, responsive to said pump shaft speed sensor indication and operably connected to said at least one inlet valve, for initiating control of said at least one inlet valve on a stroke by stroke basis thereby to supply fluid in discrete volumes to drive said motor and for altering a frequency of the supply of the discrete volumes fluid to said motor dependent upon a desired motor speed and the speed of the pump shaft.

2. A system as claimed in claim 1 and further including a temperature sensor for sensing a monitorable temperature associated with said heat source and in which said temperature sensor is operably connected to said controller for delivering temperature data thereto and said controller is programmed for controlling the supply of hydraulic fluid to said fan motor in accordance with a control strategy determined by the received temperature data.

3. A system as claimed in claim 2 wherein said controller is programmed to monitor one or more of said monitored parameters and initiate cooling in advance of a predicted demand therefore.

4. A system as claimed in claim 1 wherein said one or more sensors are configured to sense said one or more parameters including: brake position; accelerator position; throttle/gear position; engine control data; ambient temperature; vehicle weight; terrain incline; pump RPM and accessory/engine load, and wherein said sensor or sensors are connected to said controller for delivering data thereto and said controller is programmed for controlling the output of said pump in accordance with said data.

5. A system as claimed in claim 1 wherein said controller includes a look up table having data recorded thereon corresponding to pre-recorded heating or cooling profiles and wherein said controller controls said at least one inlet valve in accordance with said look up table.

6. A system as claimed in claim 1 and including an adaptive controller for learning start and stop profiles of a vehicle associated with said transmission and modifying the cooling profile in accordance therewith.

7. A system as claimed in claim 1 wherein the heat radiating surface receives heat from an internal combustion engine.

8. A system as claimed in claim 7 and including a second fluid pump driven from said engine, said second fluid pump driving a motor coupled for driving a transmission.

9. A system as claimed in claim 1 and including a transmission system incorporating said cooling system.

10. A system as claimed in claim 1 and further including a fluid radiator for receiving cooling fluid from said engine and in which said fan is positioned to draw or drive ambient air over said radiator, thereby to cool the contents thereof.

11. A system as claimed in claim 10 and having a temperature sensor wherein said temperature sensor senses the temperature of cooling fluid in a cooling circuit.

12. A system as claimed in claim 1 wherein said fan is positioned to draw or drive ambient air over a surface of said engine, thereby to cool said engine directly.

13. A system as claimed in claim 1 and having a temperature sensor wherein said temperature sensor senses the temperature of a component of said heat source.

14. A system as claimed in claim 1 wherein said at least one inlet valve is operably connected to the controller for controlling the return of said fluid to a source of the fluid, and said controller is connected to said at least one inlet valve to maintain said at least one inlet valve open when fluid is not required to drive the motor.

* * * * *